US007282016B2

(12) United States Patent
Simonson

(10) Patent No.: US 7,282,016 B2
(45) Date of Patent: Oct. 16, 2007

(54) CABLE CROSSOVER EXERCISE APPARATUS

(75) Inventor: Roy Simonson, Colorado Springs, CO (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 10/261,546

(22) Filed: Sep. 30, 2002

(65) Prior Publication Data

US 2003/0032531 A1 Feb. 13, 2003

Related U.S. Application Data

(63) Continuation of application No. 09/864,246, filed on May 25, 2001, now Pat. No. 6,458,061, which is a continuation of application No. 09/395,194, filed on Sep. 14, 1999, now Pat. No. 6,238,323.

(51) Int. Cl.
*A63B 21/062* (2006.01)

(52) U.S. Cl. ..... 482/103; 482/102; 482/138

(58) Field of Classification Search ..... 482/99–103, 482/133, 138, 136, 96, 121, 129, 130; 21/673, 21/675

See application file for complete search history.

(56) References Cited

U.S. PATENT DOCUMENTS

| | | | | |
|---|---|---|---|---|
| 321,388 | A | 6/1885 | Ruesbam | |
| 353,089 | A | 11/1886 | Smith | |
| 372,272 | A * | 10/1887 | Murphy | 482/103 |
| 374,496 | A | 12/1887 | Reach | |
| 457,400 | A | 8/1891 | Dowd | |
| 722,462 | A * | 3/1903 | Smith | 482/102 |
| 776,824 | A | 12/1904 | Bryon, Jr. | |
| 1,928,089 | A | 9/1933 | Blickman | |
| 2,436,987 | A | 3/1948 | Bailleaux | |
| 2,472,391 | A | 6/1949 | Alzibu | |
| 2,977,120 | A | 3/1961 | Morris | |
| 3,708,166 | A * | 1/1973 | Annas | 482/100 |
| 4,154,441 | A | 5/1979 | Gajda | |
| 4,372,553 | A * | 2/1983 | Hatfield | 482/105 |
| 4,402,504 | A * | 9/1983 | Christian | 482/103 |
| 4,474,370 | A | 10/1984 | Oman | |
| 4,531,727 | A * | 7/1985 | Pitre | 482/101 |

(Continued)

FOREIGN PATENT DOCUMENTS

DE 4410001 A1 * 8/1994

(Continued)

OTHER PUBLICATIONS

Cybex Expert Report—"Mechanical Engineering Analysis," 121 pages including tabs, Sep. 29, 2003.

(Continued)

*Primary Examiner*—Cary E. O'Connor
*Assistant Examiner*—Victor K. Hwang
(74) *Attorney, Agent, or Firm*—Workman Nydegger

(57) ABSTRACT

A highly versatile exercise apparatuses is disclosed. More particularly, the invention relates to a cable crossover exercise apparatus including a central weight stack and opposed extension arms. The invention also relates to a functional lift exercise apparatus including a central weight stack and substantially parallel extension arms. The invention further relates to a cable type exercise apparatus employing a pulley assembly with a 4:1 load ratio.

37 Claims, 7 Drawing Sheets

U.S. PATENT DOCUMENTS

| | | | | | |
|---|---|---|---|---|---|
| 4,603,855 | A | | 8/1986 | Sebelle | |
| 4,632,388 | A | | 12/1986 | Schleffendorf | |
| 4,635,926 | A | | 1/1987 | Minkow | |
| 4,666,151 | A | * | 5/1987 | Chillier | 482/135 |
| 4,685,670 | A | | 8/1987 | Zinkin | |
| 4,697,809 | A | | 10/1987 | Rockwell | |
| 4,721,301 | A | | 1/1988 | Drake | |
| 4,721,303 | A | | 1/1988 | Fitzpatrick | |
| 4,733,860 | A | * | 3/1988 | Steffee | 482/136 |
| 4,763,897 | A | | 8/1988 | Yakata | |
| 4,784,384 | A | | 11/1988 | Deola | |
| 4,826,157 | A | | 5/1989 | Fitzpatrick | |
| 4,834,365 | A | | 5/1989 | Jones | |
| 4,898,381 | A | * | 2/1990 | Gordon | 482/103 |
| 4,900,018 | A | | 2/1990 | Ish, III et al. | |
| 4,907,798 | A | | 3/1990 | Burchatz | |
| 4,913,423 | A | * | 4/1990 | Farran et al. | 482/130 |
| 4,974,838 | A | | 12/1990 | Sollenberger | |
| 5,044,629 | A | | 9/1991 | Ryan et al. | |
| 5,064,191 | A | | 11/1991 | Johnson | |
| 5,090,694 | A | | 2/1992 | Pauls et al. | |
| 5,102,121 | A | | 4/1992 | Solow et al. | |
| 5,211,614 | A | | 5/1993 | Henes | |
| 5,236,406 | A | | 8/1993 | Webber | |
| 5,242,344 | A | | 9/1993 | Hundley | |
| 5,250,013 | A | * | 10/1993 | Brangi | 482/98 |
| D342,106 | S | | 12/1993 | Campbell et al. | |
| 5,267,930 | A | | 12/1993 | Henes | |
| 5,348,524 | A | | 9/1994 | Grant | |
| 5,356,360 | A | | 10/1994 | Johns | |
| 5,362,290 | A | | 11/1994 | Huang | |
| 5,417,634 | A | | 5/1995 | Habing | |
| 5,429,569 | A | | 7/1995 | Gunnari | |
| 5,549,530 | A | | 8/1996 | Fulks | |
| 5,569,138 | A | * | 10/1996 | Wang et al. | 482/130 |
| 5,667,465 | A | | 9/1997 | McCollum et al. | |
| 5,674,167 | A | * | 10/1997 | Piaget et al. | 482/130 |
| 5,722,921 | A | | 3/1998 | Simonson | |
| 5,738,616 | A | | 4/1998 | Robertson | |
| 5,800,321 | A | | 9/1998 | Webber | |
| 5,897,467 | A | | 4/1999 | Habing et al. | |
| 5,906,566 | A | * | 5/1999 | Whitcomb | 482/130 |
| 5,931,767 | A | | 8/1999 | Morales | |
| 5,941,807 | A | * | 8/1999 | Cassidy et al. | 482/146 |
| 5,951,444 | A | | 9/1999 | Webber | |
| 5,961,428 | A | | 10/1999 | Webber | |
| 5,989,165 | A | | 11/1999 | Giannelli et al. | |
| 6,217,493 | B1 | * | 4/2001 | Spletzer | 482/103 |
| 6,238,323 | B1 | | 5/2001 | Simonson | |
| 6,267,711 | B1 | * | 7/2001 | Hinds | 482/121 |
| 6,458,061 | B2 | | 10/2002 | Simonson | |
| 6,488,612 | B2 | | 12/2002 | Sechrest et al. | |
| 6,491,610 | B1 | | 12/2002 | Henn | |
| 6,599,223 | B2 | | 7/2003 | Wang et al. | |
| 6,669,607 | B2 | | 12/2003 | Slawinski et al. | |
| 2003/0017918 | A1 | | 1/2003 | Webb et al. | |
| 2003/0114281 | A1 | | 6/2003 | Mackert et al. | |
| 2003/0176261 | A1 | | 9/2003 | Simonson | |

FOREIGN PATENT DOCUMENTS

| | | | | | |
|---|---|---|---|---|---|
| DE | 19704390 | A1 | | 9/1997 | |
| DE | 19801672 | A1 | | 11/1998 | |
| SU | 1743620 | A1 | | 11/1989 | |
| SU | 1586724 | | * | 8/1990 | 482/103 |
| SU | 1725744 | A3 | | 4/1992 | |

OTHER PUBLICATIONS

Cybex Expert Report—"Supplemental Mechanical Engineering Analysis," 137 pages, Oct. 28, 2003.

Defendant Cybex International, Inc.'s Supplemental Responses to Plaintiff's Interrogatories and Document Requests, 46 pages, Sep. 29, 2003.

Defendant's [Nautilus's] Supplemental Responses to Plaintiffs First Set of Interrogatories, 45 pages, Aug. 8, 2003.

Cybex Expert Report—Letter from Michael W. Starkweather, 4 pages, Dec. 19, 2003.

Plaintiff Free Motion's Memorandum of Points and Authorities in Support of Its Motion for Partial Summary Judgment that Defendant Cybex Cannot, as a Matter of Law, Sustain Its Burden of Proving that the Asserted Claims of the Patents-in-Suit are Invalid, 229 pages including tabs, Aug. 29, 2003 [filed under seal and redacted accordingly].

Defendant Cybex's Memorandum in Support of Its Motion for Summary Judgment that the Patents-in-Suit are Invalid, and Alternative Request for Time to Do Additional Discovery of Prior Art; and Memorandum in Opposition to Plaintiff's Motion for Partial Summary Judgment that Cybex Cannot Sustain Its Burden of Proving that the Asserted Claims of the Patents-in-Suit Are Invalid, 694 pages including tabs, Sep. 29, 2003.

Plaintiff Free Motion's Reply Memorandum of Points and Authorities in Further Support of Its Motion for Partial Summary Judgment that Defendant Cybex Cannot, as a Matter of Law, Sustain Its Burden of Proving that the Asserted Claims of the Patents-in-Suit Are Invalid, 36 pages including tabs, Oct. 14, 2003.

Plaintiff Free Motion's Memorandum of Points and Authorities in Opposition to Defendant Cybex's Cross-Motion for Summary Judgment that the Patents-in-Suit Are Invalid, 47 pages including tabs, Oct. 29, 2003.

Defendant Cybex's Reply Memorandum in Support of Motion for Summary Judgment that the Patents-in-Suit Are Invalid, 180 pages including tabs, Nov. 14, 2003.

Free Motion Expert Report—"Infringement Analysis," 32 pages including tabs, Aug. 21, 2003.

Free Motion Expert Report—"Infringement Analysis," 31 pages including tabs, Dec. 11, 2003.

Plaintiff Free Motion's Memorandum of Points and Authorities in Support of Its Motion for Partial Summary Judgment of Literal Infringement of Claim 1 of the '061 Patent by Defendant Cybex's FT 360 Device, 140 pages including tabs, May 9, 2003 [filed under seal and redacted accordingly].

Corrigendum to Plaintiff Free Motion's Memorandum of Points and Authorities in Support of Its Motion for Partial Summary Judgment of Literal Infringement of Claim 1 of the '061 Patent by Defendant Cybex's FT 360 Device, 6 pages including tabs, May 12, 2003 [filed under seal and redacted accordingly].

Plaintiff Free Motion's (1) Reply Memorandum in Further Support of Its Motion for Partial Summary Judgment of Literal Infringement of Claim 1 of the '061 Patent by Defendant Cybex's FT 360 Device and (2) Memorandum of Points and Authorities in Opposition to Defendant Cybex's Cross-Motion for Partial Summary Judgment of No Literal Infringement of Claim 1 of the '061 Patent by Cybex's FT 360 Device, 15 pages, Jul. 2, 2003 [filed under seal and redacted accordingly].

Defendant Cybex's Reply Memorandum in Support of Motion for Partial Summary Judgment of No Infringement, 18 pages, Jul. 8, 2003.

Plaintiff Free Motion's Memorandum of Points and Authorities in Support of Its Motion for Partial Summary Judgment of Literal Infringement of Claim 1 of the '061 Patent by Defendants' Freedom Trainer Device, 172 pages including tabs, Aug. 1, 2003.

Defendants' Memorandum in Support of Cross-Motion for Partial Summary Judgment of Non-Infringement Literally and in Opposition to Free Motion's Motion for Partial Summary Judgement of Literal Infringement of Claim 1 of the '061 patent, 29 pages, Sep. 30, 2003.

The Nautilus Group, Inc.'s Request for Judicial Notice in Support of its Reply to Cross-Motion for Partial Summary Judgment of Noninfringement Literally of Claim1 of the '061 Patent, 39 pages including tabs, Nov. 14, 2003.

Declaration of David M. Jacobson in Support of Nautilus's Cross-Motion for Partial Summary Judgment of Non-Infringement Literally and in Opposition to Free Motion's Motion for Partial Summary Judgment of Literal Infringement of Claim 1 of the '061 Patent, 13 pages including tabs, Sep. 30, 2003.
Declaration of Greg Webb in Support of Defendants'.Cross-Motion of Non-Infringement and in Opposition to Free Motion's Motion for Partial Summary Judgment of Literal Infringement of Claim 1 of the '061, 25 pages including tabs, Sep. 30, 2003.
Plaintiff Free Motion's Reply Memorandum of Points and Authorities in Further Support of Its Motion for Partial Summary Judgment of Literal Infringement of Claim 1 of the '061 Patent by Defendants' Freedom Trainer Device, 55 pages including tabs, Oct. 15, 2003.
Plaintiff Free Motion's Memorandum of Points and Authorities in Opposition to Defendants' Cross-Motion for Partial Summary Judgment No Literal Infringement of Claim 1 of the '061. Patent by Defendants' Freedom Trainer Device, 23 pages, Nov. 3, 2003.
The Nautilus Group, Inc.'s Reply to Cross-Motion for Partial Summary Judgment of Noninfringement Literally of Claim 1 of the '061 patent, 12 pages, Nov. 18, 2003.
Plaintiff Free Motion's Memorandum of Points and Authorities in Support of Its Rule 60(b)(1) Motion for Relief From the Court's Order of Dec. 30, 2003, 46 pages including tabs, Feb. 4, 2004.
Nautilus's Opposition to Free Motion's Rule 60(b)(1) Motion for Relief From the Court's Order of Dec. 30, 2003, 11, pages, Feb. 19, 2004.
Defendant Cybex's Memorandum in Opposition to Plaintiff's Rule 60(b)(1)[sic] Motion for Relief From the Court's Order of Dec. 30, 2003, 83 pages including tabs, Feb. 23, 2004.
Plaintiff Free Motion's Reply Memorandum of Points and Authorities in Further Support of Its Rule 60(b)(1) Motion for Relief from the Court's Order of Dec. 30, 2003, 10 pages, Mar. 5, 2004.
The Nautilus Group, Inc.'s Memorandum in Support of Motion for Summary Judgment of Non-Infringement Literally and Under the Doctrine of Equivalents, 13 pages, Jan. 27, 2004.
Declaration of David M. Jacobson in Support of the Nautilus Group Inc.'s Motion for Summary Judgment of Non-Infringement Literally and Under the Doctrine of Equivalents, 46 pages including tabs, Jan. 27, 2004.
Plaintiff Free Motion's Opposition to Nautilus's Motion for Summary Judgment of Noninfringement, 158 pages including tabs, Mar. 8, 2004.
Declaration of Mark A. Lewis in Support of Plaintiff Free Motion's Opposition to Nautilus's Motion for Summary Judgment of Noninfringement Under the Doctrine of Equivalents, 13 pages, Mar. 8, 2004.
The Nautilus Group, Inc.'s Reply to Motion for Summary Judgment of Non-Infringement Literally and Under the Doctrine of Equivalents, 12 pages, Mar. 25, 2004.
Second Declaration of David M. Jacobson in Support of the Nautilus Group Inc.'s Motion for Summary Judgment of Non-Infringement Literally and Under the Doctrine of Equivalents, 8 pages including tabs, Mar. 25, 2004.
Defendant Cybex's Memorandum in Support of Motion for Complete Summary Judgment of Non-Infringement Literally and Under the Doctrine of Equivalents, 44 pages including tabs, Feb. 4, 2004.
Plaintiff Free Motion's Memorandum in Opposition to Cybex's Motion for Summary Judgment of Non-Infringement, 184 pages including tabs, Mar. 15, 2004.
Declaration of Mark A. Lewis in Support of Plaintiff Free Motion's Opposition to Cybex's Motion for Summary Judgment of Non-Infringement, 16 pages, Mar. 15, 2004.
Objection to Order Granting the Nautilus Group, Inc.'s Motion for Summary Judgement of Non-Infringement Literally and Under the Doctrine of Equivalence, 20 pages including tabs, Jun. 7, 2004.
Objection to Cybex's Proposed Summary Judgment Dismissing Plaintiff's Claims Against Defendant Cybex and Proposed Findings, Conclusions and Order Granting Cybex's Motion for Complete Summary Judgment of Non-Infringement, 20 pages including tabs, Jun. 7, 2004.
Cybex's Response to Plaintiff's Objection to Cybex's Proposed Order and Summary Judgment, 8 pages, Jun. 9, 2004.
Amended Objection to Proposed Order Granting The Nautilus Group, Inc.'s Motion for Summary Judgment of Non-Infringement Literally and Under the Doctrine of Equivalence, 7 pages, Jun. 10, 2004.
Response to Amended Objection to Proposed Order Granting the Nautilus Group, Inc.'s Motion for Summary Judgment of Non-Infringement Literally and Under the Doctrine of Equivalents, 5 pages, Jun. 11, 2004.
Memorandum Opinion & Order Re: Free Motion and Cybex's Cross-Motions for Summary Judgment as to Infringement of Claim One of Patent '061; and Free Motion and Nautilus' Cross Motions for Summary Judgment as to Infringement of Claim One of Patent '061, 20 pages, Dec. 30, 2003.
Order Denying Defendant Cybex's Motion for Summary Judgment That the Patents in Suit are Invalid, 5 pages, Apr. 15, 2004.
Order Denying Plaintiff Free Motion's Rule 60(b)(1) Motion for Relief From the Court's Order of Dec. 30, 2003, 5 pages, Apr. 15, 2004.
Order Denying Plaintiff Free Motion's Motion for Partial Summary Judgment That Defendant Cybex Cannot, as a Matter of Law, Sustain Its Burden of Proving that the Asserted Claims of the Patents in Suit are Invalid, 5 pages, Apr. 15, 2004.
Order Re: Defendants' Motions for Summary Judgment, 10 pages, Aug. 10, 2004.
Stipulation and Final Judgment, 6 pages, Aug. 31, 2004.
Plaintiff's Supplemental Responses to Defendant's First Set of Interrogatories, 11 pages, Oct. 21, 2002.
Plaintiff Ground Zero's Supplemental Initial Disclosures, 7 pages, Oct. 7, 2002.
Defendant's Objection to Plaintiff's First Set of Interrogatories, 4 pages, Sep. 6, 2002.
Defendant's Initial Disclosure Under Fed.R.Civ.P. 26(a)(1), 8 pages, Jul. 31, 2002.
Plaintiff Ground Zero's Initial Disclosures, 5 pages, Jul. 31, 2002.
Plaintiff' Answers to Defendant's First Set of Interrogatories, 19 pages, Jul. 30, 2002.
Plaintiff Free Motion's First Supplemental Responses and Objections to Defendants' First Set of Interrogatories (Interrogatory Nos. 1 and 6), 36 pages, Aug. 5, 2003.
Defendant's Responses to Plaintiff's First Set of Interrogatories, 17 pages, Jul. 9, 2003.
Plaintiff Free Motion's Responses and Objections' First Set of Interrogatories, 17 pages, Jun. 27, 2003.
Defendants' Fed.R.Civ.P. 26(a) Initial Disclosures, 3 pages, Jun. 10, 2003.
Rule 26(a) Initial Disclosures [Free Motion], 4 pages, Jun. 9, 2003.
Defendant's Supplemental Responses and Objections to Plaintiff's First Set of Interrogatories, 6 pages, Mar. 19, 2003.
Plaintiff's Third Supplemental Responses to Defendant's First Set of Interrogatories, 9 pages, Feb. 28, 2003.
Free Motion's Responses to Defendant's Second Set of Interrogatories, 28 pages, Feb. 18, 2003.
Defendant's Responses and Objections to Plaintiff's Second Set of Interrogatories, 15 pages, Feb. 11, 2003.
Plaintiff's Second Supplemental Responses to Defendant's First Set of Interrogatories, 14 pages, Feb. 7, 2003.
Supplemental Responses and Objections to Nautilus' First Set of Interrogatories to Free Motion (No. 7), 7 pages, Jan. 28, 2004.
Supplemental Rule 26(a) Initial Disclosures [Free Motion], 5 pages, Jan. 28, 2004.
Responses and Objections to Nautilus'0 Second Set of Interrogatories to Free Motion, 18 pages, Jan. 21, 2004.
Deposition of Stewart L. Gitler, 75 pages, Jun. 3, 2003.
Deposition of Howard Flaxman, 60 pages, Jun. 4, 2003.
Deposition of Roy Richard Simonson, vol. I, 82 pages, Mar. 10, 2003.
Deposition of Roy Richard Simonson, vol. II, 74 pages, Mar. 11, 2003.
Deposition of Roy Richard Simonson, vol. III, 78 pages, Mar. 12, 2003.
Deposition of William Daleabout, 83 pages, Mar. 13, 2003.
Deposition of Tom Neppl, 39 pages, Mar. 4, 2003.
Deposition of Rich A. Compton, 42 pages, Mar. 3, 2003.
Plaintiff Free Motion's Reply to the Amended Counterclaim of Defendant Cybex, 7 pages, Dec. 2, 2002.
Second Amended Complaint of Patent Infringement (Jury Trial Demanded), 35 pages with tabs, Nov. 8, 2002.

Amended Answer, Affirmative Defenses and Counterclaims of the Nautilus Group, Inc. and Nautilus Human Performance Systems, Inc., 9 pages, Sep. 11, 2003.
Plaintiff Free Motion's Reply to the Amended Answer, Affirmative Defenses and Counterclaims of the Nautilus Group, Inc. and Nautilus Human Performance Systems, Inc., 8 pages, Oct. 14, 2003.
Amended Complaint for patent Infringement (Jury Trial Demanded), 35 pages with tabs, Oct. 30, 2002.
Amended Answer of Defendant Cybex International, Inc. to Amended Complaint of Patent Infringement and Amended Counterclaim to Plaintiff's Amended Complaint, 76 pages including tabs, Nov. 13, 2002.
Brief for Appellant Free Motion Fitness, Inc., 110 pages, Dec. 6, 2004.
Brief of Defendant—Appellee Cybex International, Inc., 80 pages, Jan. 14, 2005.
Brief of Appellees The Nautilus Group, Inc., et al. 45 pages, Jan. 18, 2005.
Reply Brief for Appellant Free Motion Fitness, Inc., 45 pages, Feb. 4, 2005.
Joint Appendix (vol. I of II—pp. A1 to A1928), 466 pages, Feb. 11, 2005.
Joint Appendix (vol. II of II—pp. A1956 to A3991), 444 pages, Feb. 11, 2005.
Notice of Entry of Judgment Accompanied by Opinion, 28 pages, Sep. 16, 2005.
Cybex International, Inc.'s Combined Petitions for Panel Rehearing and Rehearing En Banc, 48 pages, Sep. 28, 2005.
Petition for Panel Rehearing and Rehearing En Banc of Defendants-Appellees The Nautilis Group, Inc. (f/k/a/ Direct Focus, Inc.) and Nautilus Human Performance Systems, Inc., 48 pages, Sep. 29, 2005.
Ground Zero, *Strength Training Equipment*, Owner's Manual, upon information and belief, available at least as early as Jan. 2001 (80 pages(excluding section dividers)).
New Product Introductions for 2002, upon information and belief, available at least as early as Jun. 9, 2005, *available at* http://www.fitnessmanagement.com/FM/tmpl/genPage.asp?p=/information/articles/library/features/0102features-1.html.
Paramount Functional Trainer PFT-200, upon information and belief, available at least as early as Jul. 1, 2004, *available at* http://www.paramountfitness.com/showroom/pft/page_pft.html.
Judgment, 28 pages, Issued as a Mandate: Nov. 10, 2005.

* cited by examiner

CABLE CROSSOVER EXERCISE APPARATUS

This patent application is a continuation of U.S. patent application Ser. No. 09/864,246 filed on May 25, 2001, entitled "Cable Crossover Exercise Apparatus," inventor Roy Simonson, which has been assigned U.S. Pat. No. 6,458,061, and which is a continuation of U.S. patent application Ser. No. 09/395,194, filed on Sep. 14, 1999, entitled "Cable Crossover Exercise Apparatus," now U.S. Pat. No. 6,238,323, each of which are incorporated herein in their entirety by reference.

BACKGROUND OF THE INVENTION

1. Field of the Invention

The invention relates to highly versatile exercise apparatuses. More particularly, the invention relates to a cable crossover exercise apparatus including a central weight stack and opposed extension arms. The invention also relates to a functional lift exercise apparatus including a central weight stack and substantially parallel extension arms. The invention further relates to a cable type exercise apparatus employing a pulley assembly with a 4:1 load ratio.

2. Description of the Prior Art

The prior art of exercise apparatuses is replete with multipurpose machines providing users with a variety of possible exercising positions. Unfortunately, the majority of these exercise apparatuses are large, cumbersome and difficult to utilize.

Those skilled in the art will, therefore, appreciate the need for a compact, easy-to-use exercise apparatus which provides users with a variety of possible exercise positions. The present invention provides such an exercise apparatus.

In addition, these exercise apparatuses commonly employ a weight stack actuated by a cable which is pulled by users of the apparatus. Such arrangements present significant limitations affecting the usefulness of the exercise apparatus. For example, the range of exercises which may be performed with such cable actuated apparatuses is sometimes limited by the effective length of cable linking the weight stack with the user. In most instances, the effective useful length of the cable is limited by the height of the weight stack; that is, for each foot the cable is pulled by the user, the weight stack must rise a proportional distance. Where the rise of the weight stack is substantially equal to the distance which the cable is pulled, the effective useful length of the cable is limited to only a few feet since building weight stacks any larger would be cost prohibitive, as well as structurally undesirable.

Weight stack based exercise apparatuses also encounter problems as a result of the momentum created when the weight plates are lifted under the control of a cable. Specifically, when the weight plates are lifted upwardly at a fast pace, the generated momentum creates momentary reductions and increases in the perceived force encountered by the user of the exercise apparatus. Such momentary changes are highly undesirable.

As a result, a need further exists for an exercise apparatus overcoming the shortcomings of prior art cable assemblies. The exercise apparatus should provide an extended length of effective cable and reduce the undesirable effects of momentum created as the weight plates are moved up and down within the weight stack. The present invention provides such an exercise apparatus.

SUMMARY OF THE INVENTION

It is, therefore, an object of the present invention to provide an exercise apparatus including a resistance assembly and a cable linking a first extension arm and a second extension arm to the resistance assembly. The first extension arm includes a first end selectively supported adjacent the resistance assembly and a free second end from which the first strand of the cable system extends for engagement by a user. Similarly, the second extension arm includes a first end selectively supported adjacent the resistance assembly and a free second end from which the second strand of the cable system extends for engagement by a user. The first extension arm extends away from the second extension arm, moving the second end of the first extension arm away from the second end of the second extension arm to define an extended opposed spacing of the first and second strands.

It is also an object of the present invention to provide an exercise apparatus wherein the first extension arm and the second extension arm are substantially parallel as they extend from the resistance assembly.

It is still a further object of the present invention to provide an exercise apparatus wherein the cable passes over a series of pulleys which create a 4:1 load ratio for each user handle.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
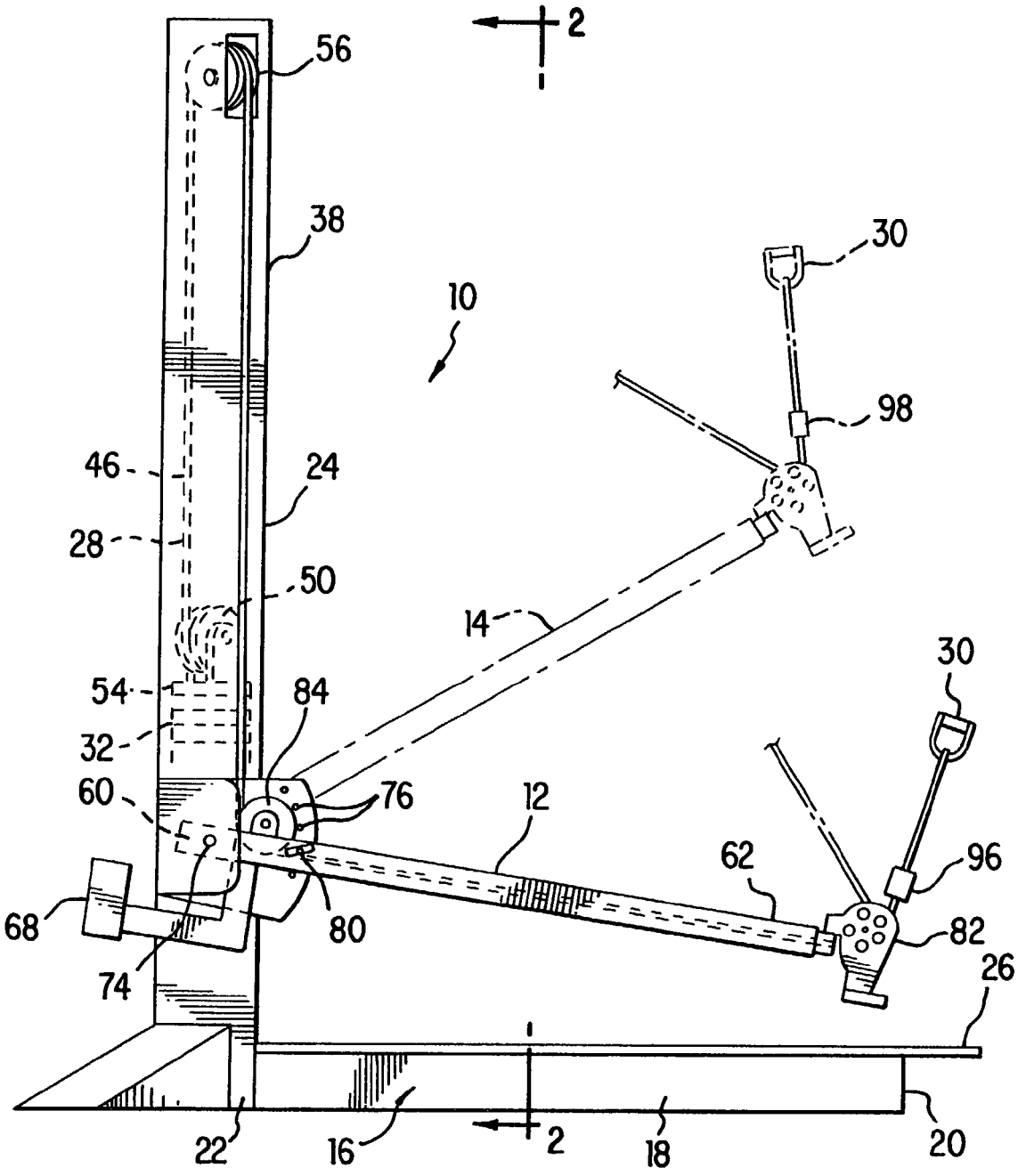
FIG. 1 is a side view of the functional lift exercise apparatus in accordance with the present invention.
Figure 3:
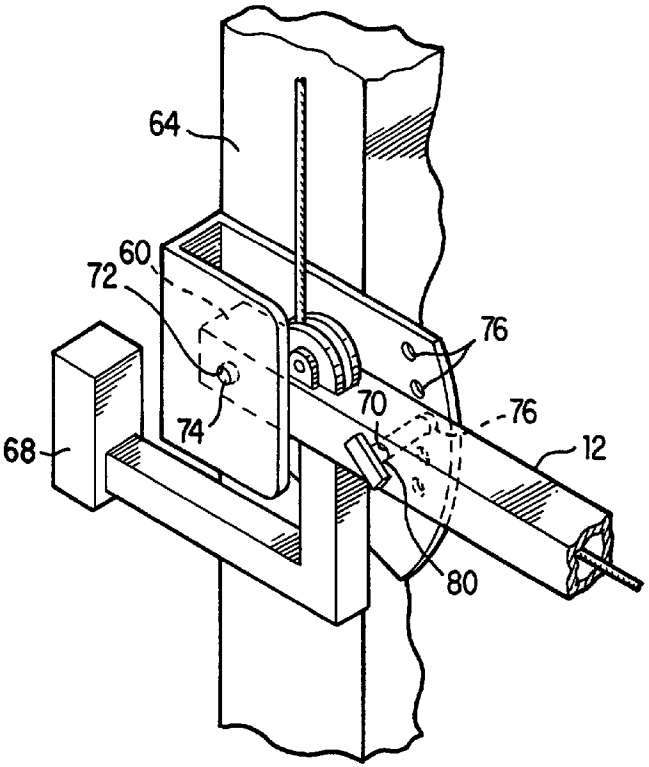
FIG. 3 is a detailed perspective view of the first end of the extension arm.
Figure 2:
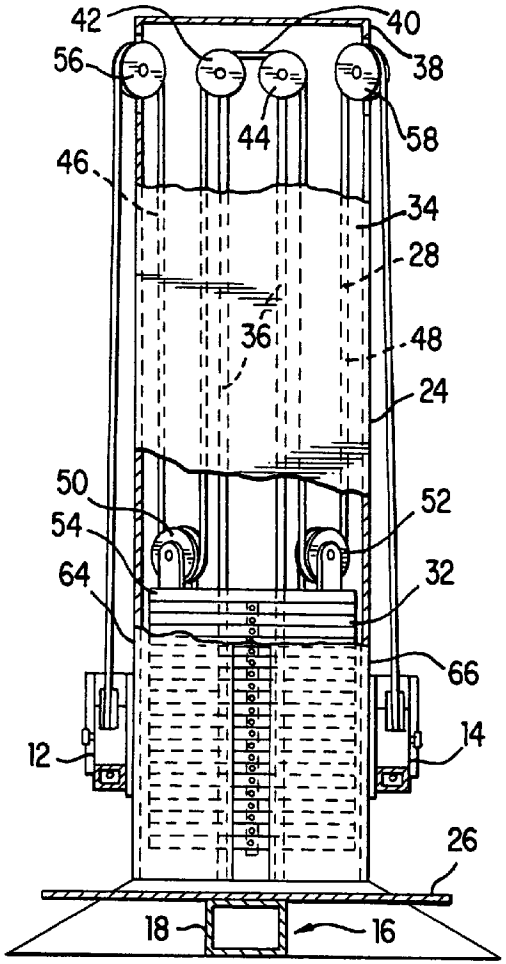
FIG. 2 is a cross sectional view of the functional lift exercise apparatus along the line 2-2 in FIG. 1 with the weight stack shown in partial cross section.

With reference to FIGS. 1 to 3, a functional lift exercise apparatuses 10 is disclosed. The functional lift exercise apparatus 10 includes a pair of parallel extension arms 12, 14 positioned to facilitate a wide range of lifting type exercises.

The functional lift exercise apparatus 10 further includes a base structure 16 having a central user support member 18 with a free first end 20 and a second end 22 to which a weight stack 24 is secured. Between the first end 20 and the second end 22, the central user support member 18 includes a platform 26 sized, shaped and constructed to support a standing user while he or she operates the present functional lift 10. The base structure 16, as well as the remaining structural components of the exercise apparatus 10, are preferably formed from steel, although other materials may also be used without departing from the spirit of the present invention.

A single cable 28 links the user handles 30 with the weight stack 24. The cable 28 is run through a series of pulleys to provide a 4:1 load ratio for each handle 30. In this way, a four hundred pound stack of weight plates 32 may be moved by the application of one hundred pounds force at each handle 30 of the functional lift 10 (two hundred pounds total force when both handles are used simultaneously).

The 4:1 ratio reduces the inertia of the weight plates 32 by reducing the rate of movement of the weight plates 32 compared to the rate of travel at the handle 30. Single hand movements allow the handle 30 to move four times faster than the weight plates 32 and dual hand movement allows the handles 30 to move twice the speed of the weight plates 32.

The 4:1 ratio also provides single hand movements equal in length to four times the travel distance of the weight plates 32. This allows extended movements, such as, for example, overhead lift and bicep curls in addition to the dead lift movements, to provide users with greater flexibility in choosing a desired resistance level.

Referring specifically to FIG. 2, the weight stack 24 includes a support frame 34 with vertical support members 36 aligned to support the stack of weight plates 32. The weight plates 32 are supported for movement up and down in a conventional manner. In fact, the pulley system, which is discussed below in greater detail, is used to lift the weight plates 32. The weight stack 24 is covered by a protective sleeve 38 positioned thereabout.

As briefly discussed above, a single cable 28 actuates the weight stack 24 and controls the movement of the weight plates 32. The central portion 40 of the cable 28 is passed over first and second central upper pulleys 42, 44. The central upper pulleys 42, 44 are positioned adjacent the upper end of the weight stack 24, although the exact positioning of the central upper pulleys 42, 44 may be varied without departing from the spirit of the present invention.

Opposite strands 46, 48 of the cable 28 then extend downwardly within the weight stack 24 to respectively engage first and second movement pulleys 50, 52. The movement pulleys 50, 52 are attached to a coupling member 54 directly attached to the stack of weight plates 32. In this way, upward movement of the movement pulleys 50, 52 causes the coupling member 54 to move upwardly, and ultimately lift the weight plates 32 against the force of gravity.

The first and second strands 46, 48 then extend upwardly and respectively pass over first and second exit pulleys 56, 58. After passing over the exit pulleys 56, 58, and exiting the confines of the weight stack 24, the opposite strands 46, 48 extend downwardly until they enter the first and second extension arms 12, 14. Although a preferred orientation is disclosed for the various pulleys used in accordance with the present invention, those skilled in the art will readily understand that the exact orientation of the pulleys may be varied without departing from the spirit of the present invention.

The first and second extension arms 12, 14 are pivotally coupled to the base portion of the weight stack 24 and extend outwardly toward the central user support member 18, that is, parallel to the central user support member 18. Each extension arm 12, 14 pivots about a pivot axis and the pivot axes of the first and second extension arms 12, 14 are substantially aligned.

The first and second extension arms 12, 14 are substantially identical and will now be described with reference to the first extension arm 12. Referring to FIGS. 1 and 3, the first extension arm 12 includes a first end 60 and a second end 62. The first extension arm 12 is pivotally coupled, at a position near the first end 60 of the extension arm 12, to a first side 64 of the weight stack 24 adjacent the base of the weight stack 24 (the second extension arm 14 is pivotally coupled to the opposite second side 66 of the weight stack 24). In fact, the first extension arm 12 is pivotally coupled in a manner allowing a user to select a desired orientation for the first extension arm 12 relative to the weight stack 24 and to lock the extension arm 12 in place. Movement of the first extension arm 12 is controlled by the inclusion of a counterweight 68 at the first end 60 of the first extension arm 12.

With reference to FIG. 3, the first extension arm 12 includes a locking hole 70. The locking hole 70 is located adjacent a pivot hole 72 through which a pivot pin 74 passes to pivotally couple the first extension arm 12 to the weight stack 24. The locking hole 70 is aligned with a series of flange holes 76 formed on a semicircular flange of the weight stack 24. The semicircular flange is positioned substantially parallel to the plane in which the first extension arm 12 rotates as it moves relative to the weight stack 24.

In practice, and as those skilled in the art will readily appreciate, a locking pin 80 is passed though an aligned locking hole 70 and flange hole 76 to lock the extension arm 12 at a desired angular orientation relative to the weight stack 24. When a user desires to change the angular orientation of the first extension arm 12, the locking pin 80 is simply removed and the locking hole 70 is aligned with another flange hole 76 at which time the locking pin 80 is once again inserted in position to lock the first extension arm 12 relative to the weight stack 24.

The second end 62 of the first extension arm 12 is fitted with a pivoting pulley 82 which guides the first strand 46 of the cable 28 as it exits the first extension arm 12. With reference to the prior discussion regarding the pulley assembly employed in accordance with the present invention, once the first strand 46 of the cable 28 passes over the exit pulley 56 and moves downwardly into engagement with the extension arm 12, the first strand 46 passes over a guide pulley 84 located at the first end 60 of the first extension arm 12. The first strand 46 of the cable 28 passes over the first guide pulley 84 and enters the tubular passageway formed in the first extension arm 12. In one embodiment, first guide pulley 84 has an axis of rotation offset distally from and substantially parallel to an axis of rotation of the first extension arm 12, as illustrated in FIG. 1.

Upon reaching the second end 62 of the first extension arm 12, the first strand 46 passes over the pivoting pulley 82 and is ready for engagement by a user of the present apparatus. The distal end of the first strand 46 of the cable 28 may be fitted with a wide variety of handles 30 known to those skilled in the art.

Figure 4:
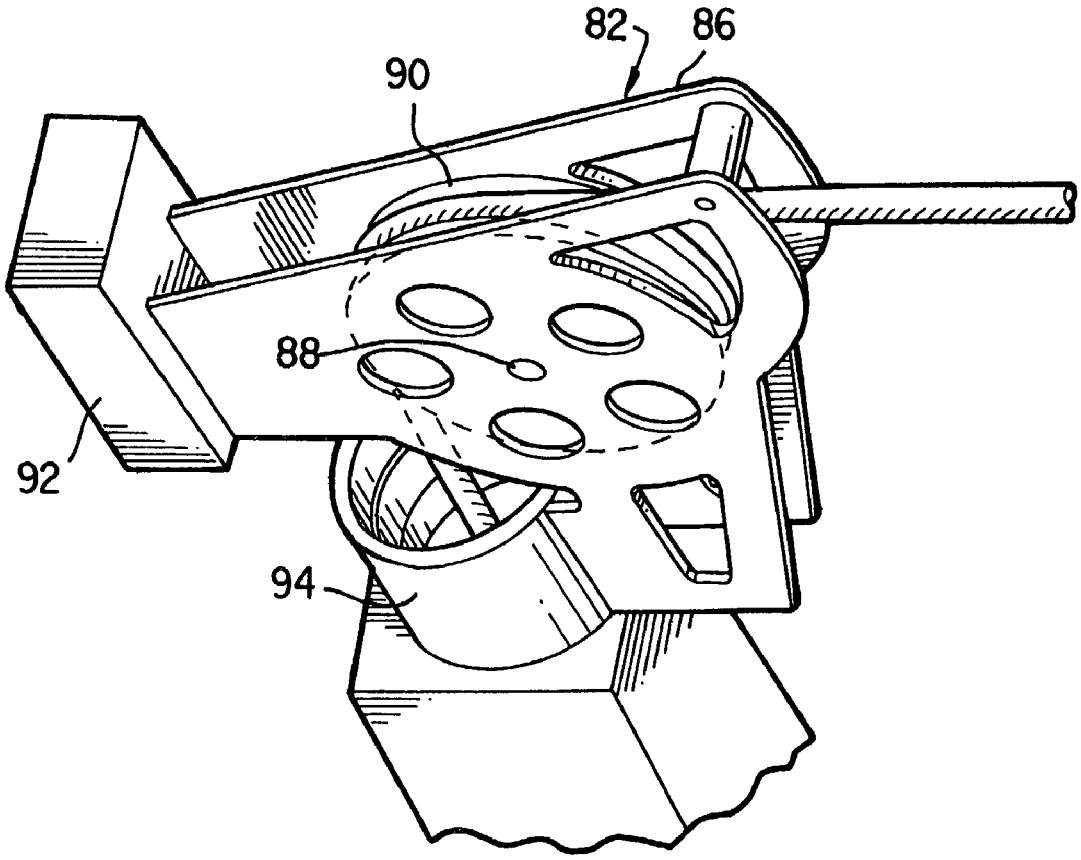
FIG. 4 is a perspective view of the pivoting pulley.
Figure 5:
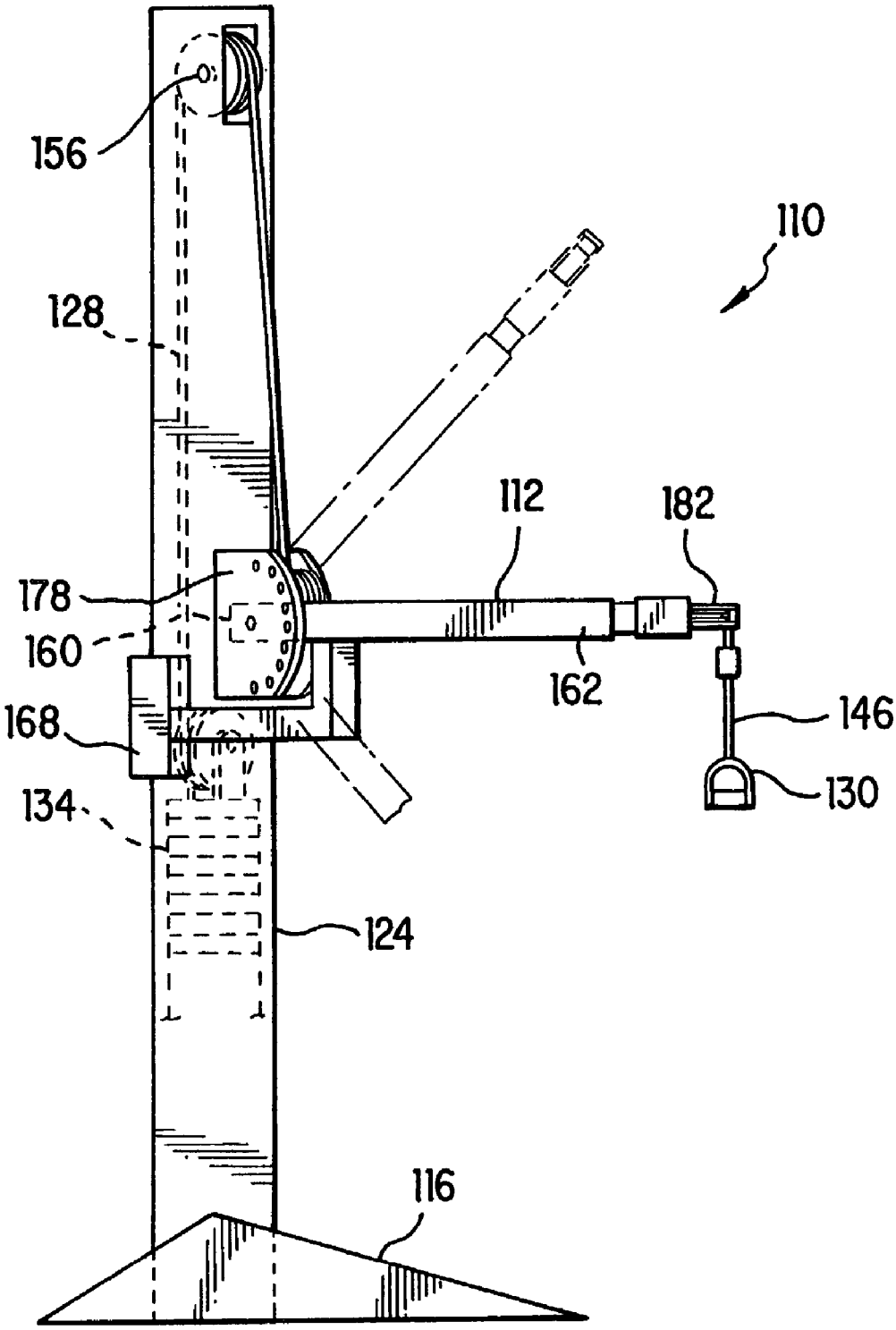
FIG. 5 is a side view of the cable crossover exercise apparatus in accordance with the present invention.

The pivoting pulley 82 is shown in greater detail in FIG. 4. Each pivoting pulley 82 includes a frame 86 with a central pivot 88 for rotatably supporting a pulley member 90. The frame 86 is formed so as to cover the pulley member 90 and thereby prevent undesired access with the pulley member 90 as the cable 28 passes thereover. The frame 86 is further provided with a counterweight 92 opposite the pulley member 90.

The frame 86 further includes a cylindrical coupling member 94 shaped and dimensioned for pivotal attachment to the second end 62 of the first extension arm 12. The cylindrical coupling member 94 provides an opening through which the cable 28 passes as it extends from the extension arm 12 toward the pulley member 90. In this way, the cable 28 passes along the axis about which the pivoting pulley 82 pivots relative to the extension arm 12 to provide greater freedom of motion as an individual attempts to draw the cable 28 in various directions during exercise.

Since the pivoting pulley 82 permits a great degree of flexibility with regard to the angle at which the cable 28 is drawn from the extension arm 12 the inclusion of the present pivoting pulleys 82 at the distal end of each extension arm 12, 14 greatly increases the flexibility of the present exercise apparatus.

The respective ends of the first and second strands 46, 48 are each provided with stop members 96, 98. As those skilled in the art will readily appreciate, the stop members 96, 98 control motion of the single cable 28 to allow exercise by pulling the first strand 46 alone, the second strand alone 48, or both strands at the same time.

In use, and after the first and second extension arms are properly positioned in a desired orientation, the user stands upon the central member, grips the handles secured to the ends of the respective strands and performs desired lifting exercises.

With reference to FIGS. 5 to 8, a cable crossover exercise apparatus 110 is disclosed. As with the functional lift exercise apparatus 10, the cable crossover exercise apparatus 110 includes a pair of extension arms 112, 114 positioned to facilitate a wide range of lifting type exercises. In contrast to the functional lift exercise apparatus 10, and as will be discussed in greater detail below, the extension arms 112, 114 of the cable crossover 110 extend in opposite directions to provide the user with access to cable ends positioned for gripping when a user fully extends his or her arms outwardly in opposite directions.

The cable crossover exercise apparatus 110 includes a base structure 116 having a central support member 118 upon which a weight stack 124 is secured. In this way, the weight stack 124 forms the center of the cable crossover exercise apparatus 110 as the first and second extension arms 112, 114 extend outwardly away from the weight stack 124 in opposite directions.

As with the functional lift exercise apparatus 10, a single cable 128 links the user handles 130 to the weight stack 124. The cable 128 is run through a series of pulleys to provide a 4:1 load ratio for each handle. In this way, a four hundred pound weight stack may be moved by the application of one hundred pounds force at each handle 130 of the cable crossover 110 (two hundred pounds total force when both handles are used simultaneously).

Figure 6:
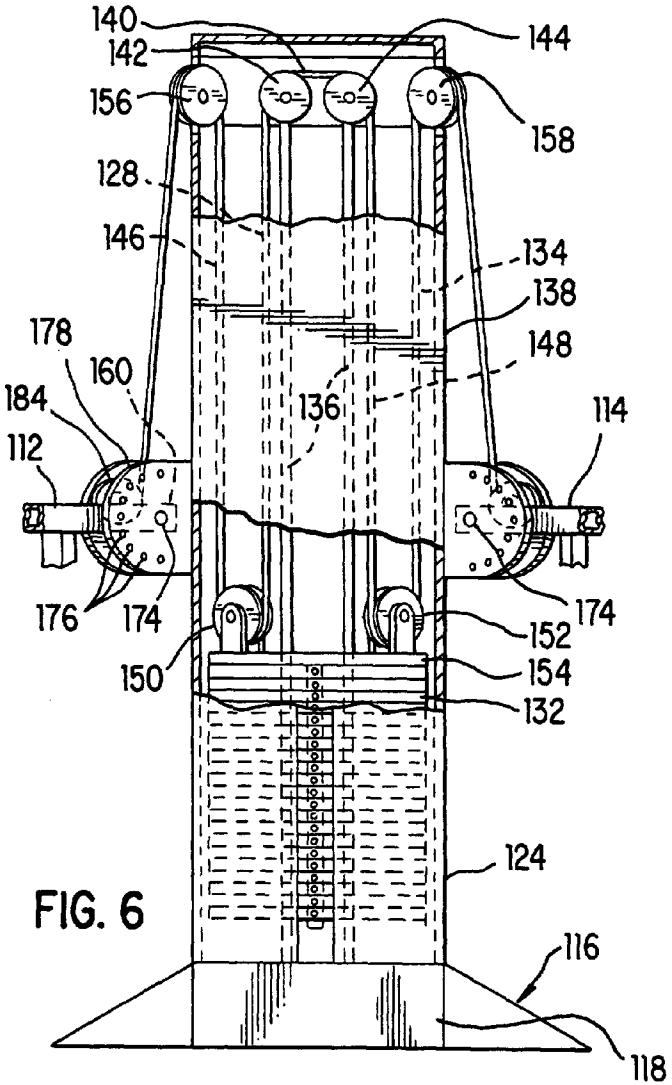
FIG. 6 is a front view of the cable crossover exercise apparatus with the weight stack shown in partial cross section.
Figure 8:
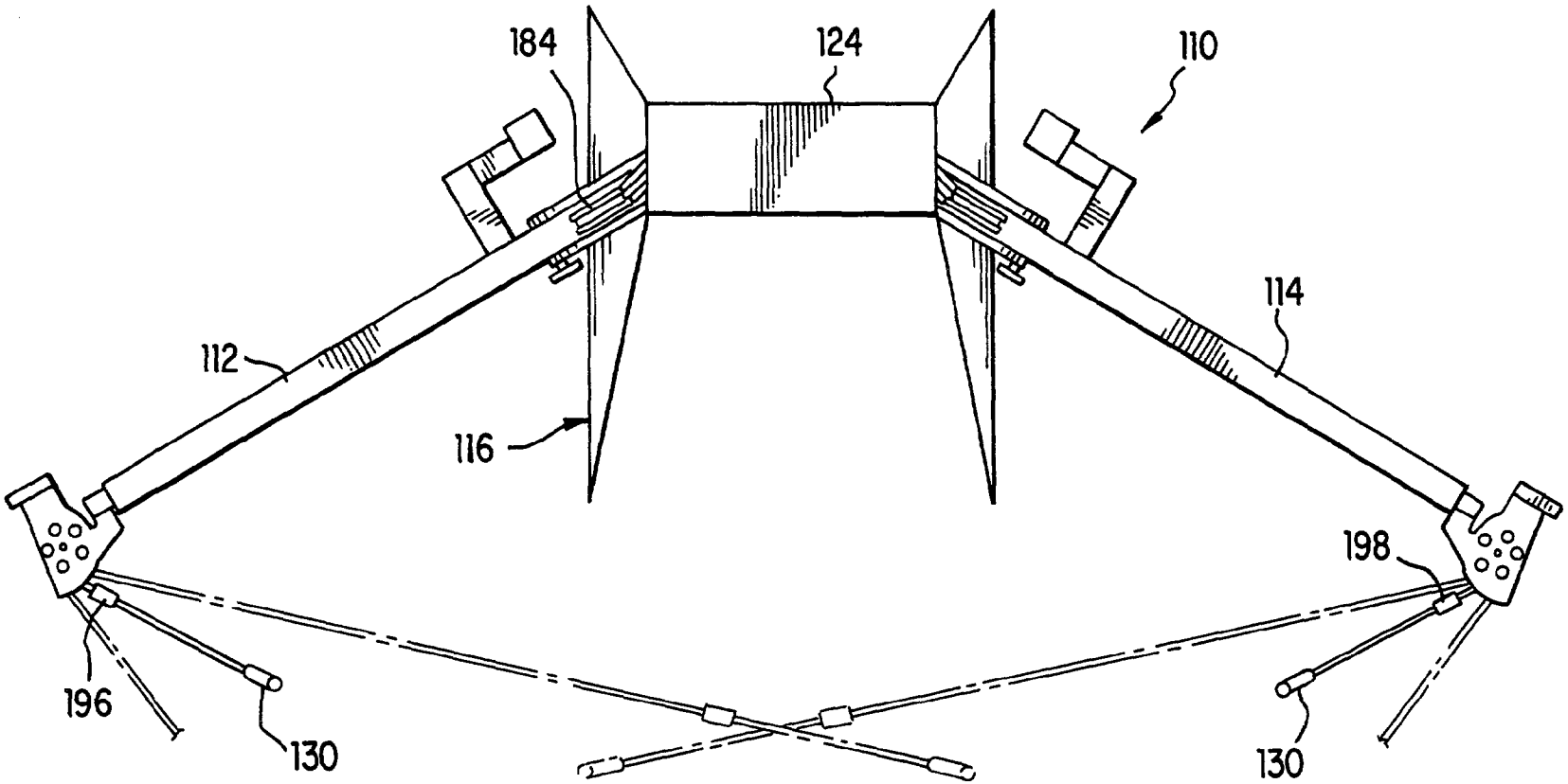
FIG. 8 is a top view of the cable crossover exercise apparatus.

With reference to FIG. 6, the weight stack 124 secured to the central support member 118 includes support frame 134 having vertical support members 136 aligned to support a stack of weight plates 132. The weight plates 132 are supported for movement up and down in a conventional manner. In fact, the pulley system, which is discussed below in greater detail, is used in lifting the weight plates 132. The weight stack 124 is covered by a protective sleeve 138 positioned thereabout.

When force is applied by the user, the cable 128 lifts the stack of weight plates 132. The central portion 140 of the cable 128 is passed over first and second central upper pulleys 142, 144. The central upper pulleys 142, 144 are positioned adjacent the upper end of the weight stack 124, although the exact positioning of the central upper pulleys 142, 144 may be varied without departing from the spirit of the present invention.

First and second strands 146, 148 of the cable 128 then extend downwardly within the weight stack 124 to respectively engage first and second movement pulleys 150, 152. The movement pulleys 150, 152 are attached to a coupling member 154 directly coupled to the stack of weight plates 132. In this way, upward movement of the movement pulleys 150, 152 causes the coupling member 154 to move upwardly, and ultimately lifts the weight plates 132 upwardly against the force of gravity.

The first and second strands 146, 148 then extend upwardly and respectfully pass over first and second exit pulleys 156, 158. After passing over the exit pulleys 156, 158, and exiting the confines of the weight stack 124, the opposite strands 146, 148 extend downwardly until they enter the first and second extension arms 112, 114 which are discussed below in greater detail. Although a preferred orientation is disclosed for the various pulleys used in accordance with the present invention, those skilled in the art will readily understand that the exact orientation of the pulleys may be varied without departing from the spirit of the present invention.

The first and second extension arms 112, 114 are pivotally coupled to a central portion of the weight stack 124 and extend outwardly from the central support member 118. The first and second extension arms 112, 114 respectively rotate about a first axis and a second axis, which are positioned to orient the first and second extension arms 112, 114 in an opposed relationship. Specifically, the first and second extension arms 112 and 114 extend toward a user at a slight angle relative to a vertical plane in which the weight stack 124 lies. In this way, the ends of the extension arms 112, 114 are moved from the stack to improve user access to the present apparatus 110 while exercising. As those skilled in the art will readily appreciate, the exact angular orientation of the arms is not critical and may be varied slightly without departing from the spirit of the present invention.

The extension arms 112, 114 are subsequently identical and will now be described with reference to the first extension arm 112. The first extension arm 112 includes a first end 160 and a second end 162. In accordance with the preferred embodiment of the present invention, the first arm 112 is approximately 32 inches from pivot point 174 to the end of the table, although those skilled in the art will appreciate that the length of the first extension arm 112 may be varied slightly without departing from the spirit of the present invention.

The first extension arm 112 is pivotally coupled, at a position near the first end 160 of the extension arm 112, to a semicircular flange assembly 178 secured to the front of weight stack 124. The semicircular flange assembly 178 includes a pair of opposed flat plates and is mounted to lie within the plane in which the first extension arm 112 rotates as it moves relative to the weight stack 124. Movement of the first extension arm 112 is controlled by the inclusion of a counterweight 168 at the first end 160 of the first extension arm 112.

The first extension arm 112 is pivotally coupled in a manner allowing a user to select a desired orientation for the extension arm 112 and lock the extension arm 112 in place. Specifically, the first extension arm 112 includes a locking hole 170 located adjacent a pivot hole 172 through which a pivot pin 174 passes to pivotally couple the first extension arm 112 to the semicircular flange assembly 178, and ultimately, the weight stack 124. The locking hole 170 is aligned with a series of flange holes 176 formed in the semicircular flange assembly 178 of the weight stack 124.

In practice, and as those skilled in the art will readily appreciate, a locking pin 180 is passed though an aligned locking hole 170 and flange hole 176 to lock the first extension arm 112 at a desired angular orientation relative to the weight stack 124. When a user desires to change the angular orientation of the first extension arm 112, the locking pin 180 is simply removed and the locking hole 170 is aligned with another flange hole 176 at which time the locking pin 180 is once again inserted in position to lock the first extension arm 112 relative to the weight stack 124.

Figure 7:
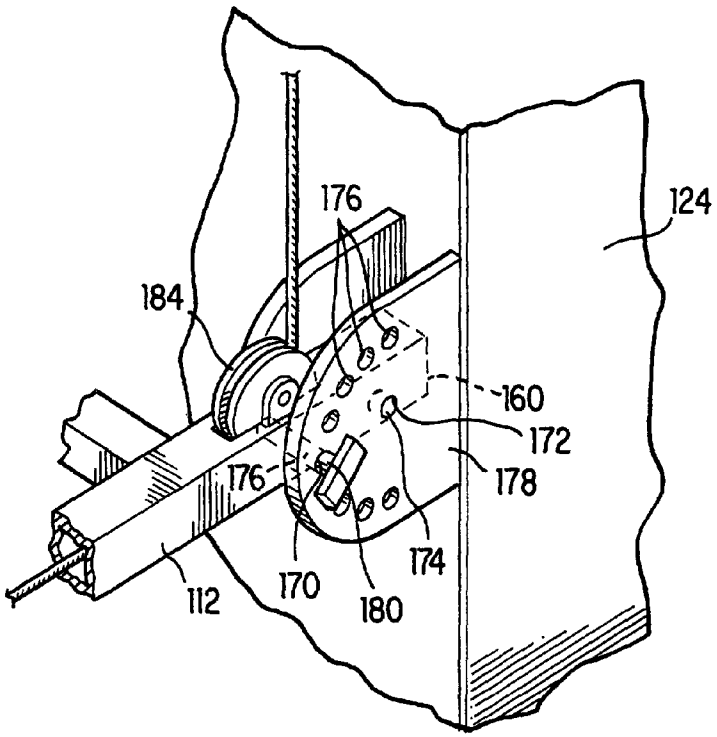
FIG. 7 is a detailed perspective view of the flange assembly of the cable crossover exercise apparatus.

The second end 162 of the first extension arm 112 is fitted with a pivoting pulley 182 to guide the first strand 146 of the cable 128 as it exits the first extension arm 112. With reference to the prior discussion regarding the pulley assembly employed in accordance with the present invention, once the first strand 146 of the cable 128 passes over the exit pulley 156 and moves downwardly into engagement with the first extension arm 112, the first strand passes over a guide pulley 184 located at the first end 160 of the first extension arm 112. The first strand 146 of the cable 128 passes over the first guide pulley 184 and enters the tubular passageway formed in the first extension arm 112. In one embodiment, first guide pulley 184 has an axis of rotation offset distally from and substantially parallel to an axis of rotation of the first extension arm 112, as illustrated in FIGS. 6 and 7.

Figure 9:
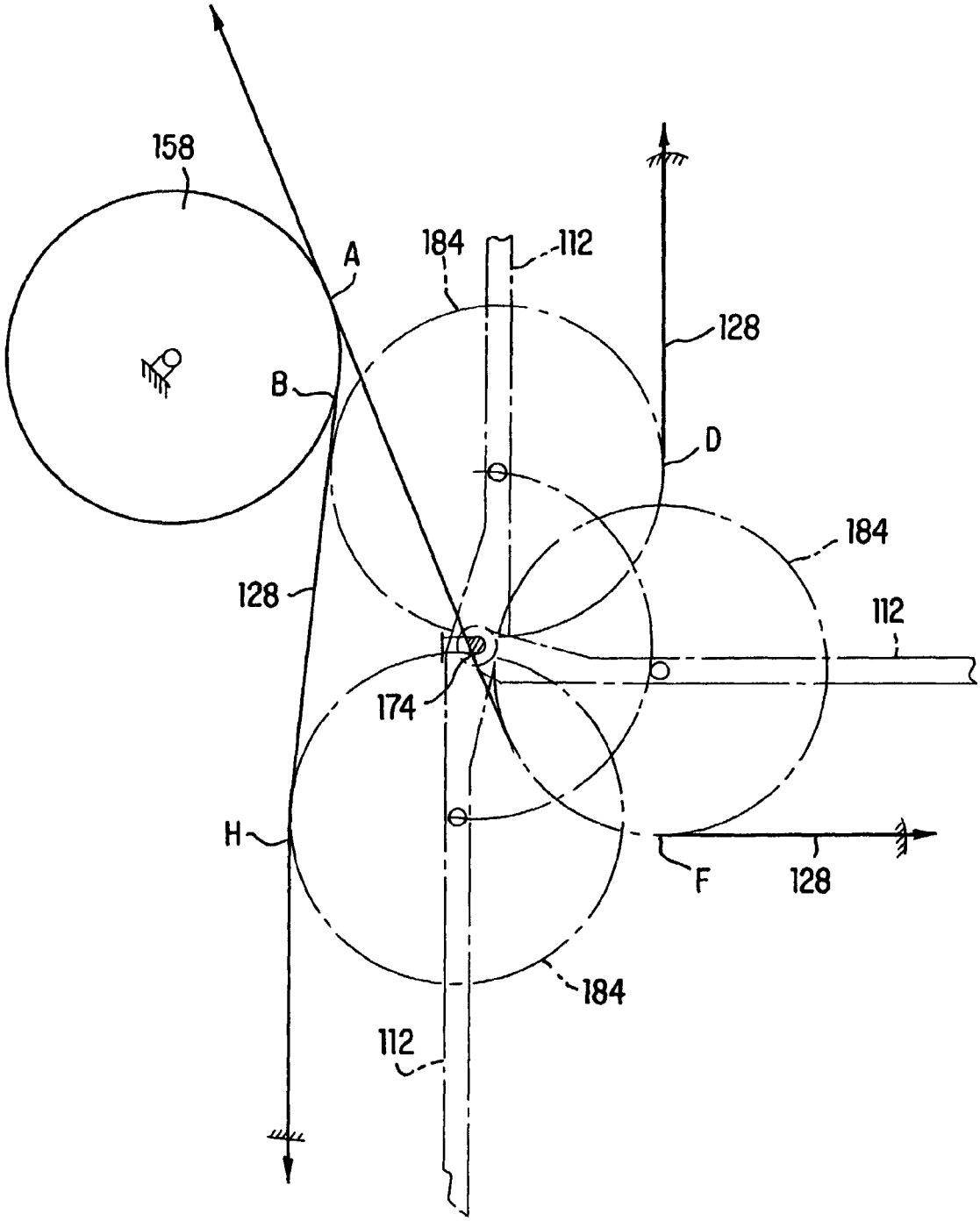
FIG. 9 is a schematic showing the relative orientation of a cable guide pulley.

In an attempt to reduce the tightening or loosening of the cable 128 as the first extension arm 112 is rotated, the first guide pulley 184 is positioned to ensure that the cable tension does not vary as the extension arm 112 is rotated. Specifically, and with reference to FIG. 9, the first guide pulley 184 is positioned to ensure that A:D=A:F=A:H.

Upon reaching the second end 162 of the first extension arm 112, the first strand 146 passes over the pivoting pulley 182 and is ready for engagement by a user of the present apparatus 110. The distal end of each strand 146, 148 of the cable 128 may be fitted with a wide variety of handles 130 known to those skilled in the art.

The pivoting pulley 182 is substantially the same as that disclosed in FIG. 4 and discussed above in substantial detail. Since the pivoting pulley 182 permits a great degree of flexibility with regard to the angle at which the cable 128 is drawn from the first extension arm 112, the inclusion of the present pivoting pulley 182 at the distal end of each extension arm 112, 114 greatly increases the flexibility of the present exercise apparatus.

The respective ends of the first and second strands 146, 148 are each provided with stop members 196, 198. As those skilled in the art will readily appreciate, the stop members 196, 198 control motion of the single cable to allow exercise by pulling the first strand 146 alone, the second strand 148 alone, or both strands at the same time.

In use, and after the extension arms are properly positioned in a desired orientation, the user stands in front of the weight stack, grips the handles secured to the ends of the respective strands and performs desired lifting exercises.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is hereby claimed is:

1. An exercise apparatus, comprising:

a resistance assembly;

a cable linking a first extension arm and a second extension arm to the resistance assembly, wherein the cable includes a first strand and a second strand; wherein the first extension arm includes a first end pivotally supported adjacent the resistance assembly, and a free second end;

a first pulley having an axis of rotation offset distally from and substantially parallel to an axis of rotation of the first extension arm, wherein the first strand of the cable passes over the first pulley, then immediately extends toward the free end of the first extension arm; and wherein the second extension arm includes a first end pivotally supported adjacent the resistance assembly and a free second end; and a second pulley having an axis of rotation offset distally from and substantially parallel to an axis of rotation of the second extension arm, wherein the second strand of the cable passes over the second pulley, then immediately extends toward the free end of the second extension arm.

2. An apparatus as recited in claim 1, further comprising a first flange assembly on the resistance assembly and a second flange assembly on the resistance assembly, wherein the first extension arm is coupled to the first flange assembly and the second extension arm is coupled to the second flange assembly, wherein the first and second pulleys are positioned adjacent respective flange assemblies.

3. An apparatus as recited in claim 1, wherein the resistance assembly comprises a support frame and a stack of weight plates and wherein movement of the cable moves the weight plates.

4. An exercise apparatus as recited in claim 1, wherein the first strand of the cable passes over the first pulley, then enters the first end of the first extension arm, then exits the second end of the first extension arm, and the second strand of the cable passes over the second pulley, then enters the first end of the second extension arm, then exits the second end of the second extension arm.

5. An exercise apparatus, comprising:

a resistance assembly;

a cable linking a first extension arm and a second extension arm to the resistance assembly, wherein the cable includes a first strand and a second strand; wherein the first extension arm includes a first end pivotally supported adjacent the resistance assembly, and a free second end, the first extension arm having a first axis of rotation;

a first pulley having an axis of rotation offset distally from and substantially parallel to the first axis of rotation, the first pulley positioned adjacent the first end of the first extension arm such that the first strand of the cable passes over the first pulley, then immediately extends toward the free end of the first extension arm; and wherein the second extension arm includes a first end pivotally supported adjacent the resistance assembly and a free second end, the second extension arm having a second axis of rotation; and a second pulley having an axis of rotation offset distally from and substantially parallel to the second axis of rotation, the second pulley positioned adjacent the first end of the second extension arm such that the second strand of the cable passes over the second pulley, then immediately extends toward the free end of the second extension arm, wherein the first strand of the cable enters the first end of the first extension arm and exits the second end of the first extension arm, and the second strand of the cable enters the first end of the second extension arm and exits the second end of the second extension arm.

6. An exercise apparatus, comprising:

a resistance assembly;

a cable having a first strand and a second strand;

a first extension arm having a first end pivotally supported adjacent the resistance assembly and a free second end from which the first strand of the cable extends, the first extension arm having a first axis of rotation;

a second extension arm having a first end pivotally supported adjacent the resistance assembly and a free second end from which the second strand of the cable extends, the second extension arm having a second axis of rotation, wherein the cable is moveable through the first and second extension arms against resistance provided by the resistance assembly;

a first pulley positioned adjacent a first opening of the first extension arm such that the first pulley immediately directs the first strand of the cable into the first opening of the first extension arm, the first strand exiting a second opening of the first extension arm, the second opening being located at the free end of the first extension arm, the first pulley having an axis of rotation that is parallel to and offset distally from the first axis of rotation; and a second pulley positioned adjacent a first opening of the second extension arm such that the second pulley immediately directs the second strand of the cable into the first opening of the second extension arm, the second strand exiting a second opening of the second extension arm, the second opening of the second extension arm being located at the free end of the second extension arm, the second pulley having an axis of rotation that is parallel to and offset distally from the second axis of rotation.

7. The exercise apparatus of claim 6, wherein the resistance assembly comprises a support frame and a stack of weight plates, and wherein the cable engages a pulley system including a pulley coupled to the stack of weight plates, and wherein the cable is moveable through the first and second extension arms against resistance provided by the weight plates such that the cable links the first extension arm and the second extension arm to the resistance assembly.

8. An exercise apparatus as recited in claim 6, wherein the resistance assembly comprises a support frame and a stack of weight plates, and wherein the cable engages a pulley system including a pulley coupled to the stack of weight plates, and wherein the cable is moveable through the first and second extension arms against resistance provided by the weight plates.

9. An apparatus as recited in claim 6, wherein the apparatus comprises a first flange assembly coupled to the resistance assembly and a second flange assembly coupled to the resistance assembly, wherein the first end of the first extension arm is pivotally coupled to the first flange assembly and the first end of the second extension arm is pivotally coupled to the second flange assembly.

10. An apparatus as recited in claim 9, wherein the first and second pulleys are positioned adjacent respective flange assemblies.

11. An exercise apparatus, comprising:

a resistance assembly;

a cable having a first strand and a second strand;

a first extension arm having a first end pivotally supported adjacent the resistance assembly and a free second end from which the first strand of the cable extends, the first extension arm having a first axis of rotation;

a second extension arm having a first end pivotally supported adjacent the resistance assembly and a free second end from which the second strand of the cable extends, the second extension arm having a second axis of rotation, wherein the cable is moveable through the first and second extension arms against resistance provided by the resistance assembly;

a first pulley positioned adjacent the first end of the first extension arm such that the first pulley immediately directs the first strand of the cable into a first opening of the first extension arm, the first strand exiting a second opening of the first extension arm, the first pulley having an axis of rotation that is parallel to and offset distally from the first axis of rotation; and a second pulley positioned adjacent the first end of the second extension arm such that the second pulley immediately directs the second strand of the cable into a first opening of the second extension arm, the second strand exiting a second opening of the second extension arm, the second pulley having an axis of rotation that is parallel to and offset distally from the second axis of rotation.

12. An exercise apparatus, comprising:

a resistance assembly;

a cable having a first strand and a second strand;

a first flange assembly on the resistance assembly;

a second flange assembly on the resistance assembly;

a first extension arm having a first end pivotally coupled to the first flange assembly and a free second end from which the first strand of the cable extends, the first extension arm having a first axis of rotation;

a second extension arm having a first end pivotally coupled to the second flange assembly and a free second end from which the second strand of the cable extends, the second extension arm having a second axis of rotation, wherein the cable is moveable against resistance provided by the resistance assembly;

a first pulley having an axis of rotation that is parallel to and offset distally from the first axis of rotation, the first strand extending over the first pulley, then immediately extending into the first extension arm_toward the free end of the first extension arm; and a second pulley having an axis of rotation that is parallel to and offset distally from the second axis of rotation, the second strand extending over the second pulley, then immediately extending into the second extension arm_toward the free end of the second extension arm.

13. An exercise apparatus as recited in claim 12, wherein: (i) the first flange assembly comprises a plate; and (ii) the second flange assembly comprises a plate.

14. An exercise apparatus as recited in claim 12, wherein the resistance assembly comprises a support frame and a stack of weight plates, and wherein the cable engages a pulley system including a pulley coupled to the stack of weight plates, and wherein the cable is moveable through the first and second extension arms against resistance provided by the weight plates.

15. An exercise apparatus as recited in claim 12, further comprising a first pin configured to selectively lock the first extension arm with respect to the first flange assembly, the first pin having an axis that is parallel to and offset from the first axis, and a second pin configured to selectively lock the second extension arm with respect to the second flange assembly, the second pin having an axis that is parallel to and offset from the second axis.

16. An exercise apparatus as recited in claim 12, wherein the first strand of the cable passes over the first pulley, then enters the first end of the first extension arm, then extends along the first extension arm, then exits the second end of the first extension arm, and the second strand of the cable passes over the second pulley, then enters the first end of the second extension arm, then extends along the second extension arm, then exits the second end of the second extension arm.

17. An exercise apparatus, comprising:

a resistance assembly;

a cable having a first strand and a second strand;

a first flange assembly on the resistance assembly;

a second flange assembly on the resistance assembly;

a first extension arm having a first end pivotally coupled to the first flange assembly and a free second end from which the first strand of the cable extends, the first extension arm having a first axis of rotation;

a second extension arm having a first end pivotally coupled to the second flange assembly and a free second end from which the second strand of the cable extends, the second extension arm having a second axis of rotation, the cable extending through the first and second arms, wherein the cable is moveable against resistance provided by the resistance assembly;

a first pulley having an axis of rotation that is parallel to and offset distally from the first axis of rotation, the first strand extending over the first pulley and then immediately through the first extension arm; and a second pulley having an axis of rotation that is parallel to and offset distally from the second axis of rotation, the second strand extending over the second pulley and then immediately through the second extension arm, wherein the first pulley is adjacent the first flange assembly and the second pulley is adjacent the second flange assembly.

18. An exercise apparatus, comprising:

a resistance assembly;

a cable having a first strand and a second strand;

a first extension arm assembly coupled to the resistance assembly, the first extension arm assembly having (i) a first pivoting extension arm and (ii) a first pulley positioned such that the first strand of the cable passes over the first pulley, then immediately extends along the first extension arm, then extends past a free end of the first extension arm, the first pulley having an axis of rotation that is parallel to and offset distally from an axis of rotation of the first extension arm; and a second extension arm assembly coupled to the resistance assembly, the second extension arm assembly having (i) a second pivoting extension arm and (ii) a second pulley positioned such that the second strand of the cable passes over the second pulley, then immediately extends along the second extension arm, then extends past a free end of the second extension arm, the second pulley having an axis of rotation that is parallel to and offset distally from an axis of rotation of the second extension arm, wherein the cable is moveable against resistance provided by the resistance assembly;

wherein the first extension arm assembly and the second extension arm assembly are capable of independent movement.

19. An exercise apparatus as recited in claim 18, wherein the first strand of the cable passes over the first pulley, then enters a first end of the first extension arm, then exits the second, free end of the first extension arm, and the second strand of the cable passes over the second pulley, then enters a first end of the second extension arm, then exits the second, free end of the second extension arm.

20. An exercise apparatus, comprising:

a resistance assembly;

a cable having a first strand and a second strand;

a first extension arm assembly coupled to the resistance assembly, the first extension arm assembly having (i) a first pivoting extension arm and (ii) a first pulley positioned such that the first strand of the cable passes over the first pulley, then immediately extends toward the free end of the first extension arm, the first pulley having an axis of rotation that is parallel to and offset distally from an axis of rotation of the first extension arm; and a second extension arm assembly coupled to the resistance assembly, the second extension arm assembly having (i) a second pivoting extension arm and (ii) a second pulley positioned such that the second strand of the cable passes over the second pulley, then immediately extends toward the free end of the second extension arm, the second pulley having an axis of rotation that is parallel to and offset distally from an axis of rotation of the second extension arm, the cable is moveable against resistance provided by the resistance assembly;

wherein the first extension arm assembly and the second extension arm assembly are capable of independent movement, and wherein the first extension arm assembly further comprises a first flange assembly coupled to the resistance assembly, the first pivoting arm being pivotally coupled to the first flange assembly; and wherein the second extension arm assembly further comprises a second flange assembly coupled to the resistance assembly, the second pivoting arm being pivotally coupled to the second flange assembly, wherein the first flange assembly comprises a first plate and a second plate and the second flange assembly comprises a first plate and a second plate, and wherein the first pulley is positioned such that the first strand of the cable is moveable between the first and second plates of the first flange assembly, then along the surface of the first pulley and then into the first extension arm, and wherein the second pulley is positioned such that the second strand of the cable is moveable between the first and second plates of the second flange assembly, then along the surface of the second pulley and then into the second extension arm.

21. An exercise apparatus as recited in claim 20, wherein the resistance assembly comprises a support frame and a stack of weight plates, and wherein the cable engages a pulley system including a pulley coupled to the stack of weight plates, and wherein the cable is moveable through the first and second extension arms against resistance provided by the weight plates, the cable thereby linking the first extension arm assembly and the second extension arm assembly to the resistance assembly.

22. An exercise apparatus, comprising:

a resistance assembly;

a cable having a first strand and a second strand;

a first extension arm assembly coupled to the resistance assembly, the first extension arm assembly having (i) a first flange assembly coupled to the resistance assembly, (ii) a first extension arm pivotally coupled to the first flange assembly; and (iii) a first pulley positioned such that the first strand of the cable is moveable adjacent the first flange assembly along the surface of the first pulley and into the first extension arm, the first pulley having an axis of rotation that is parallel to and offset distally from an axis of rotation of the first extension arm; and a second extension arm assembly coupled to the resistance assembly, the second extension arm assembly having (i) a second flange assembly coupled to the resistance assembly, (ii) a second extension arm pivotally coupled to the second flange assembly; and (iii) a second pulley positioned such that the second strand of the cable is moveable adjacent the second flange assembly along the surface of the second pulley and into the second extension arm, the second pulley having an axis of rotation that is parallel to and offset distally from an axis of rotation of the second extension arm, the cable extending through the first and second arms, wherein the cable is moveable against resistance provided by the resistance assembly, wherein the first flange assembly comprises a first plate and a second plate and the second flange assembly comprises a first plate and a second plate, wherein the first extension arm is linked to the first and second plates of the first flange assembly and the second extension arm is linked to the first and second plates of the second flange assembly, and wherein the first pulley is positioned such that the first strand of the cable is moveable between the first and second plates of the first flange assembly, along the surface of the first pulley and into the first extension arm, and wherein the second pulley is positioned such that the second strand of the cable is moveable between the first and second plates of the second flange assembly, along the surface of the second pulley and into the second extension arm, and wherein the first pulley is positioned between the first and second plates of the first flange assembly and the second pulley is positioned between the first and second plates of the second flange assembly.

23. An exercise apparatus, comprising:

a resistance assembly;

a cable having a first strand and a second strand;

a first extension arm assembly coupled to the resistance assembly, the first extension arm assembly having (i) a first flange assembly coupled to the resistance assembly, the first flange assembly having first and second plates; (ii) a first extension arm pivotally coupled to the first flange assembly, the first extension arm having a first axis of rotation; (iii) a first pulley positioned such that the first strand of the cable is moveable between the first and second plates of the first flange assembly, along the surface of the first pulley and into the first extension arm at a location adjacent the first flange assembly, the first pulley having an axis of rotation that is parallel to and offset distally from the first axis of rotation; and (iv) a first locking pin configured to selectively lock the first extension arm into a desired position with respect to the first flange assembly; and a second extension arm assembly coupled to the resistance assembly, the second extension arm assembly having (i) a second flange assembly coupled to the resistance assembly, the second flange assembly having first and second plates; (ii) a second extension arm pivotally coupled to the second flange assembly, the second extension arm having a second axis of rotation; (iii) a second pulley positioned such that the second strand of the cable is moveable between the first and second plates of the second flange assembly, along the surface of the second pulley and into the second extension arm at a location adjacent the second flange assembly, the second pulley having an axis of rotation that is parallel to and offset distally from the second axis of rotation; and (iv) a second locking pin configured to selectively lock the second extension arm into a desired position with respect to the second flange assembly; and wherein the cable engages a pulley system including a pulley linked to a stack of weight plates, the cable extending through the first and second arms, wherein the cable is moveable against resistance provided by the weight plates.

24. An exercise apparatus as recited in claim 23, wherein the cable links the first extension arm assembly and the second extension arm assembly to the resistance assembly.

25. An exercise apparatus as recited in claim 24, wherein the first locking pin has an axis that is parallel to the first axis of rotation.

26. An exercise apparatus, comprising:

a resistance assembly;

a cable having a first strand and a second strand;

a first extension arm assembly coupled to the resistance assembly, the first extension arm assembly having (i) a first flange assembly coupled to the resistance assembly; (ii) a first extension arm pivotally coupled to the first flange assembly; and (iii) a first pulley having a portion thereof positioned internally with respect to first and second portions of the first extension arm such that the first pulley directs the first strand of the cable into a first opening of the first extension arm, the first strand exiting a second opening located at a free end of the first extension arm, the first pulley having an axis of rotation that is parallel to and offset distally from an axis of rotation of the first extension arm; and a second extension arm assembly coupled to the resistance assembly, the second extension arm assembly having (i) a second flange assembly coupled to the resistance assembly; (ii) a second extension arm pivotally coupled to the second flange assembly and (iii) a second pulley having a portion thereof positioned internally with respect to first and second portions of the second extension arm such that the second pulley directs the second strand of the cable into a first opening of the second extension arm, the second strand exiting a second opening located at a free end of the second extension arm, the second pulley having an axis of rotation that is parallel to and offset distally from an axis of rotation of the second extension arm, wherein the cable is moveable within the first and second extension arms against resistance provided by the resistance assembly.

27. An exercise apparatus as recited in claim 26, wherein a portion of the first pulley is positioned directly between first and second walls of the first extension arm and a portion of the second pulley is positioned between first and second walls of the second extension arm.

28. The exercise apparatus of claim 26, wherein the resistance assembly comprises a support frame and a stack of weight plates, and wherein the cable engages a pulley system including a pulley coupled to the stack of weight plates, and wherein the cable moves through the first and second extension arms against resistance provided by the weight plates, the cable thereby linking the first extension arm assembly and the second extension arm assembly to the resistance assembly.

29. An exercise apparatus, comprising:

a resistance assembly;

a cable linked to the resistance assembly, the cable having a first strand and a second strand;

a first extension arm having (i) a first end pivotally supported adjacent the resistance assembly; and (ii) a free second end, the first extension arm having a first axis of rotation;

a second extension arm having (i) a first end pivotally supported adjacent the resistance assembly; and (ii) a free second end, the second extension arm having a second axis of rotation;

a first pulley positioned adjacent the first end of the first extension arm such that the first strand of the cable contacts the first pulley, then immediately extends toward the free end of the first extension arm, wherein the first strand_exits the free end of the first extension arm, the first pulley having an axis of rotation that is parallel to and offset distally from the first axis of rotation;

a second pulley positioned adjacent the first end of the second extension arm such that the second strand of the cable contacts the second pulley, then immediately extends toward the free end of the second extension arm, wherein the second strand exits the free end of the second extension arm, the second pulley having an axis of rotation that is parallel to and offset distally from the second axis of rotation.

30. An apparatus as recited in claim 29, wherein the first strand of the cable extends into a first opening of the first extension arm, then extends out a second opening of the first extension arm and wherein the second strand of the cable extends into a first opening of the second extension arm, then extends out a second opening of the second extension arm.

31. An apparatus as recited in claim 30, wherein, after exiting the second opening of the first extension arm, the first strand of the cable then contacts a pulley of a first rotating assembly coupled to the first extension arm, and after exiting the second opening of the second extension arm, the second strand of the cable then contacts a pulley of a second rotating assembly coupled to the second extension arm.

32. An apparatus as recited in claim 29, wherein the first strand of the cable extends between the first pulley and a pulley of a first pivoting pulley assembly and wherein the second strand of the cable extends from the second pulley to a pulley of a second pivoting pulley assembly.

33. An exercise apparatus, comprising:

a resistance assembly;

a cable having a first strand and a second strand;

a first extension arm having (i) a first end pivotally supported adjacent the resistance assembly; and (ii) a free second end, the first extension arm having a first axis of rotation;

a second extension arm having (i) a first end pivotally supported adjacent the resistance assembly; and (ii) a free second end, the second extension arm having a second axis of rotation;

a first pulley positioned such that the first strand of the cable extends from the first pulley immediately toward a first rotating pulley assembly coupled to the free end of the first extension arm, the first pulley having an axis of rotation that is parallel to, adjacent to, and offset distally from the first axis of rotation;

a second pulley positioned such that the second strand of the cable extends from the second pulley immediately toward a second rotating pulley assembly coupled to the free end of the second extension arm, the second pulley having an axis of rotation that is parallel to, adjacent to, and offset distally from the second axis of rotation, wherein the resistance assembly provides resistance to movement of the cable.

34. An exercise apparatus, comprising:

a resistance assembly;

a cable linked to the resistance assembly, the cable having a first strand and a second strand;

a first extension arm having (i) a first end pivotally supported adjacent the resistance assembly; and (ii) a free second end, the first extension arm having a first axis of rotation;

a second extension arm having (i) a first end pivotally supported adjacent the resistance assembly; and (ii) a free second end, the second extension arm having a second axis of rotation;

a first pulley having an axis of rotation that is parallel to and offset distally from the first axis of rotation;

a second pulley having an axis of rotation that is parallel to and offset distally from the second axis of rotation;

a first rotating pulley assembly coupled to the free end of the first extension arm, wherein the first strand of the cable contacts the first pulley, then immediately extends toward the free end of the first extension arm, then exits the first extension arm, and then contacts a pulley of the first rotating pulley assembly; and a second rotating pulley assembly coupled to the free end of the second extension arm, wherein the second strand of the cable contacts the second pulley, then immediately extends toward the free end of the second extension arm, then exits the second extension arm, and then contacts a pulley of the second rotating pulley assembly.

35. An exercise apparatus as recited in claim 34, wherein the first pulley is positioned such that the first strand of the cable contacts the first pulley, then extends toward the first rotating pulley assembly and wherein the second pulley is positioned such that the second strand of the cable contacts the second pulley, then extends toward the second rotating pulley assembly.

36. An exercise apparatus as recited in claim 1, 6, 11, 12, 17, 20, 22, 23, 26, 29, 33, or 34, wherein the first extension arm and the second extension arm are capable of independent movement.

37. An apparatus as recited in claim 1, 5, 11, 12, 18, 29, 33, 34, wherein the apparatus comprises a first flange assembly coupled to the resistance assembly and a second flange assembly coupled to the resistance assembly, wherein the first end of the first extension arm is pivotally coupled to the first flange assembly and the first end of the second extension arm is pivotally coupled to the second flange assembly, and wherein the first and second pulleys are positioned adjacent respective first and second flange assemblies.

* * * * *

UNITED STATES PATENT AND TRADEMARK OFFICE

CERTIFICATE OF CORRECTION

PATENT NO. : 7,282,016 B2
APPLICATION NO. : 10/261546
DATED : October 16, 2007
INVENTOR(S) : Simonson It is certified that error appears in the above-identified patent and that said Letters Patent is hereby corrected as shown below:

Title page
Item 57, Abstract, line 1, change “apparatuses” to --apparatus--

Column 5
Lines 24-25, change “second strand alone 48” to --second strand 48 alone--

Column 10
Line 45, change “arm_toward” to --arm toward--
Line 51, change “arm_toward” to --arm toward--

Column 15
Line 17, change “strand_exits” to --strand exits--

Signed and Sealed this

Twenty-second Day of July, 2008

JON W. DUDAS
*Director of the United States Patent and Trademark Office*